United States Patent [19]

Staehli

[11] Patent Number: 4,505,005

[45] Date of Patent: Mar. 19, 1985

[54] GRATING ARRANGEMENT FOR AN OPENING ROLLER FOR FIBERS

[75] Inventor: Urs Staehli, Turbenthal, Switzerland

[73] Assignee: Rieter Machine Works Limited, Winterthur, Switzerland

[21] Appl. No.: 540,887

[22] Filed: Oct. 11, 1983

[30] Foreign Application Priority Data

Oct. 26, 1982 [CH] Switzerland ..... 6225/82

[51] Int. Cl.[3] ..... D01B 3/00

[52] U.S. Cl. ..... 19/200; 19/202; 19/95

[58] Field of Search ..... 19/200, 202, 107, 95

[56] References Cited

U.S. PATENT DOCUMENTS 2,681,478 6/1954 Shaw et al. ..... 19/95
3,470,588 10/1969 Just ..... 19/202

FOREIGN PATENT DOCUMENTS 119796 7/1900 Fed. Rep. of Germany .
192188 6/1906 Fed. Rep. of Germany .
253831 1/1912 Fed. Rep. of Germany .
342505 12/1959 Switzerland .
257235 6/1927 United Kingdom ..... 19/95
265130 8/1927 United Kingdom ..... 19/95
2032478 5/1980 United Kingdom .
2083848 3/1982 United Kingdom ..... 19/107

*Primary Examiner*—Louis K. Rimrodt
*Assistant Examiner*—J. L. Kravitz
*Attorney, Agent, or Firm*—Werner W. Kleeman

[57] ABSTRACT

A grating composed of individual bars is provided for an opening roller serving for cleaning of fibers and provided with clothing. Each bar carries a guide element extending over its length and comprises a guide sheet, the spacing of which from the clothing is settable. For the purpose of adjustment, the guide element comprises a flat band portion which rests on a side surface of the bar, is shiftable substantially parallel to such side surface and is releasably secured to the bar. In known devices, setting of the spacing x of the guide sheet from the clothing is laborious because the accessibility to the position to be measured is difficult. In accordance with the invention this is avoided in that each guide element is additionally provided on the longitudinal side of the flat band portion directed away from the guide sheet with a band portion which is inclined with respect to the flat band portion, extends in the longitudinal direction of its bar and covers the back thereof.

5 Claims, 2 Drawing Figures

GRATING ARRANGEMENT FOR AN OPENING ROLLER FOR FIBERS

CROSS REFERENCE TO RELATED CASE

This application is related to the commonly assigned, copending U.S. application Ser. No. 06/544,860, filed Oct. 24, 1983, entitled "CLEANING MACHINE FOR FIBER MATERIAL", and listing as the inventor URS STAEHLI.

BACKGROUND OF THE INVENTION

The present invention relates to a new and improved grating composed of individual bars and serving for use with a rotatable opening roller provided with clothing.

In its more specific aspects, the grating of the present development is of the type wherein each grating bar has secured thereto a guide element formed of sheet material and extending over the length of the bar. Each such guide element comprises two band portions arranged adjacent each other and extending in the longitudinal direction of the bar. The first band portion forms a flat surface which rests on one side face or surface of the associated bar, and the second band portion forms a guide face or surface adjacent the clothing and extends in approximately tangential direction relative thereto. The spacing of the guide face or surface from the clothing is adjustable through shifting of the guide element essentially parallel to the mentioned side face or surface.

From German Patent Specification No. 1,685,571 and the corresponding U.S. Pat. No. 3,470,588, granted Oct. 7, 1969, such a grating is known for a cleaning machine for cotton fibers, in which the bars are provided with guide sheets adjustable in their spacing from a beater. Each guide sheet has a guide surface and a flat portion which rests on the side face of its bar directed towards the beater, the bar being inclined to the tangential direction of the beater envelope.

The spacing of the guide sheets from the beater is of considerable importance for the perfect separation of impurities from the fiber material. Accordingly, it is important that such spacing can be exactly set.

SUMMARY OF THE INVENTION

Therefore, with the foregoing in mind it is a primary object of the present invention to provide an improved construction of grating of the character described, wherein there is improved the exactness of the adjustment of the guide elements with respect to the clothing of the opening roller.

Yet a further significant object of the present invention aims at not only enhancing the accuracy of the adjustment of the guide elements, but furthermore is concerned with attaining such exact adjustment in an extremely simple and reliable manner.

A further significant object of the present invention is directed to an improved grating arrangement, wherein the guide elements carried by the bars of the grating arrangement, can be conveniently and easily positionally adjusted in a most accurate and reliable fashion.

Now in order to implement these and still further objects of the invention, which will become more readily apparent as the description proceeds, the inventive grating is manifested by the features that each of the guide elements is provided on the longitudinal side of the first band portion facing away from the second band portion with a third band portion which is inclined with respect to the first band portion. This third band portion extends in the longitudinal direction of its associated bar and at least partially covers or overlies the back thereof.

Through the provision of the inclined band portion, easily accessible measuring positions are obtained. In this way, the exactness of adjustment is markedly increased. As a result of the inclined, third band portion there is attained the additional advantage of an improvement of the stability of the guide elements, and thus, also the stability of the bars carrying the guide elements. In addition, the guide elements can be formed in such manner that with the third band portions located in abutment with the backs of the bars, the guide surfaces, that is the second band portions, are located extremely close to the clothing, while, however, contact of these parts and thus damage thereto is effectively avoided under all circumstances.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
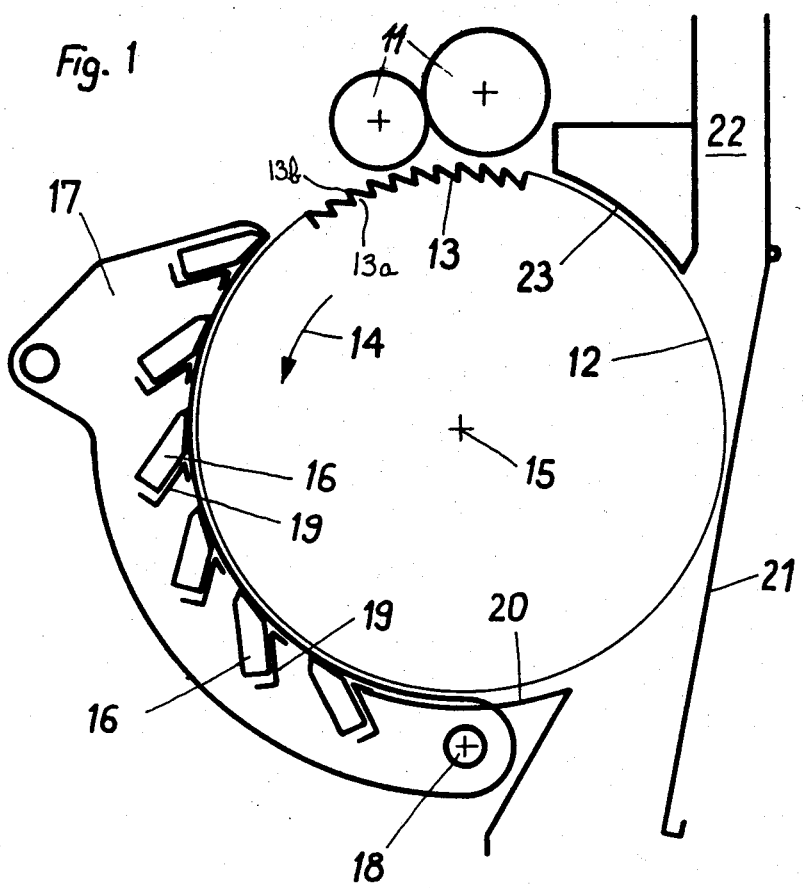
FIG. 1 shows a cross-section of a cleaning machine.

Describing now the drawings, it is to be understood that only enough of the grating and its associated opening roller has been conveniently shown in the drawings as needed for those skilled in the art to readily understand the underlying principles and concepts of the present invention, while simplifying the illustration of the drawings. Turning attention now specifically to the exemplary arrangement depicted in FIG. 1, it will be understood that a feed device, formed by two transport rollers 11, serves to feed fiber material to an opening roller 12. A clothing 13, formed of suitable teeth, is mounted on the cylindrical outer surface of the opening roller 12. This opening roller 12 is rotatable about its lengthwise axis 15 in the direction indicated by the arrow 14. Bars 16 are supported at both opposite ends thereof by respective frames, of which only the frame 17 can be seen in FIG. 1. These frames 17 are mounted to be pivotable about a shaft 18. The set of bars 16 collectively form a grating or grating arrangement. Each bar 16 has an associated guide element 19. Part of the clothing 13 is covered by a guide sheet 20. A pivotable flap 21 extends away from a suction duct or channel 22 and past the opening roller 12. There is also provided a separating or screening wall 23. The parts 11, 16, 19, 20, 21 and 23 extend in the direction of the lengthwise axis 15 over the complete length of the opening roller 12.

Figure 2:
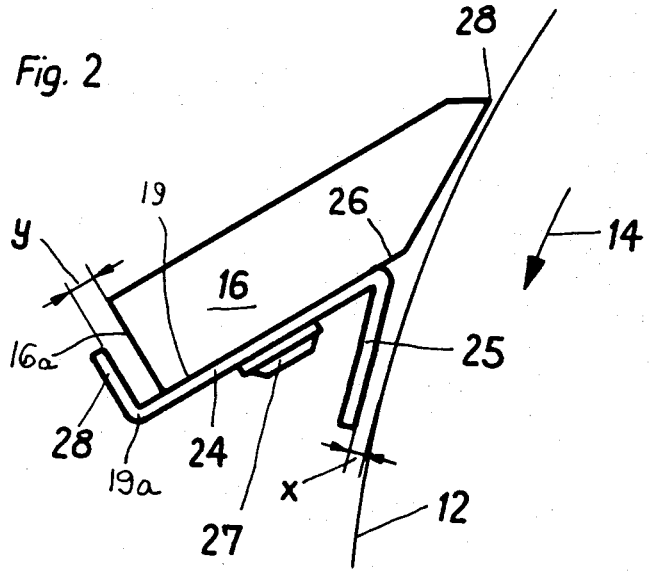
FIGS. 2 shows a cross-section of a bar and its associated guide element.

As shown in FIG. 2, the guide elements 19 of FIG. 1 comprise a first band portion 24 and a second band portion 25. These band portions 24 and 25 extend in the direction of the lengthwise axis 15 of the opening roller 12 over the complete length of such opening roller 12. Each bar 16 is inclined to the tangent (not shown) to the clothing 13 or outer surface of the opening roller 12. The first band portion 24 is of a substantially flat form and rests on the side face or wide surface 26 of the related bar 16 directed towards the opening roller 12. The guide elements 19 are secured by means of threaded bolts or screws 27 or equivalent fixation means to the bars 16. When the threaded bolts or screws 27 are released, each guide element 19 is shiftable as required in directions transverse to the longitudinal direction and parallel to the side face or wide surface 26 which is directed towards the clothing 13. By means of the threaded bolts or screws 27, each such guide element 19 can be fixed in its required position, and thus, the spacing x shown in FIG. 2 between the second band portion 25 and the clothing 13 can be randomly chosen and set freely as required.

In operation of the illustrated cleaning machine, the fiber material to be cleaned is fed by means of the transport rollers 11 to the clothing 13, and thus, is taken up by the conventional teeth 13*a* thereof during such time as the opening roller 12 is rotated. Thus, the impurities present in the fiber material, for example seeds, dust particles and the like, are propelled outwardly by centrifugal force and with the aid of the bars 16 and guide elements 19 are separated from the fibers which, during this operating phase, hang on the teeth 13*a* of the clothing 13. Thereafter, and as a result of the underpressure produced by the suction duct or channel 22 and the action of the separation or screening wall 23, the fiber material separates from the clothing 13 at the region of the flap 21 and passes through the suction duct 22 to the next processing stage.

The second band portion 25 extends at least approximately tangentially to the clothing 13 and forms a guide sheet or plate for the fiber material. Experience has shown that for optimal removal of impurities from the fibers, the position of the second band portion 25, in particular the spacing x thereof from the clothing 13, is of decisive importance. In currently available machines, exact setting of a predetermined value of x is very difficult, since the accessibility of the intermediate space between the band portion 25 and the clothing 13 is impeded and the visibility into this intermediate space is poor. In order to mitigate these disadvantages, the guide element 19 in accordance with the invention is provided on its side or end face directed away from the clothing 13 with a third band portion 28. This third band portion 28 is inclined with respect to the first band portion 24 and at least partially covers the backs or back portions 16*a* of the bars 16. In the illustrated example, the band portions 28 and the backs of the bars 16 are substantially parallel to one another. Their mutual spacing is indicated by reference character y. The spacing y can be measured much more easily and exactly than the distance or spacing x of the second band portion 25 from the clothing 13, so that laborious and difficult settings are eliminated.

The width of the first band portions 24 of the guide elements 19 is advantageously chosen in such a manner that with the third band portion 28 located in abutment with the back or back portion 16*a* of the related bar 16, there is exactly provided a minimum spacing of the second band portion 25 from the tips 13*b* of the clothing 13. In this manner, interference of parts of the clothing 13 with the second band portion 25, and thus mutual damage to these parts, is avoided under all circumstances.

Setting of a desired spacing y can be carried out with the aid of any suitable measuring instrument. Such spacing y can, however, also be set by insertion of a thickness gauge between the back of the bar 16 and the third band portion 28. In this way, the change of the distance x as a function of the change of the distance y is dependent upon the angle enclosed by the band portions 24 and 25.

While a parallel disposition of the third band portion 28 with respect to the back 16*a* of the related bar 16 will, in general, constitute a desired construction, other embodiments and arrangements of these parts are possible for specific cases. In the illustrated embodiment, the bars 16 extend between the pivotable frames 17 and are secured thereto and supported thereby. It should be clear that a further advantage of the invention resides in the fact that the inclined or flexed third band portion 28 produces an increase in the strength of the guide element 19, which, in turn, has the effect of tending to increase the strength of the related bar 16.

While there are shown and described present preferred embodiments of the invention, it is to be distinctly understood that the invention is not limited thereto, but may be otherwise variously embodied and practiced within the scope of the following claims. Accordingly,

What I claim is:

1. A grating arrangement for a rotating opening roller provided with clothing, comprising:

a plurality of individual grating bars;

a respective guide element formed from sheet material and secured to each related grating bar;

each guide element extending over the length of the related grating bar;

each grating bar having a back portion;

each guide element comprising two band portions arranged adjacent to each other and extending in the longitudinal direction of the related grating bar;

said two band portions defining first and second band portions;

said first band portion forming a substantially flat surface which rests on a side surface of the related grating bar;

said second band portion forming a guide surface located adjacent the clothing of the opening roller and extending in approximately tangential direction thereto;

said guide element being shiftable substantially parallel to said side surface of said related grating bar in order to be able to adjust the spacing of the guide surface from the clothing of the opening roller;

said first band portion having a longitudinal side directed away from the second band portion;

each guide element being provided on said longitudinal side of the first band portion directed away from the second band portion with a third band portion; and said third band portion being inclined with respect to the first band portion, extending in the longitudinal direction of its related grating bar and at least partially covering the back portion thereof.

2. The grating arrangement as defined in claim 1, wherein:

said clothing has tips; and each guide element is structured in such a manner that with the third band portion located in abutment with the back portion of the related grating bar a minimum spacing is present between the second band portion and the tips of the clothing.

3. The grating arrangement as defined in claim 1, wherein:

the third band portion is arranged substantially parallel to the back portion of the related grating bar.

4. The grating arrangement as defined in claim 1, wherein:

said third band portion is positioned in spaced relationship from said back portion of its related grating bar to enable a measuring gauge to be inserted into a gap formed between the back portion of the grating bar and the third band portion so as to enable rapid changing of the spacing of the guide surface of the second band portion from the clothing of the opening roller.

5. The grating arrangement as defined in claim 1, wherein:

said third band portion imparts increased strength to its guide element and to the related grating bar.

* * * * *